United States Patent [19]

Bauer et al.

[11] Patent Number: 4,660,019

[45] Date of Patent: Apr. 21, 1987

[54] SWITCH WITH SPEED CONTROL

[75] Inventors: Karl-Heinz Bauer, Bad Neustadt/Saale; Franz Rutterschmidt, Heustreu; Gerhard Spiller, Saal/Saale, all of Fed. Rep. of Germany

[73] Assignee: Preh Elektrofeinmechanische Werke, Jakob Preh, Nachf. GmbH & Co., Bad Neustadt/Saale, Fed. Rep. of Germany

[21] Appl. No.: 671,632

[22] Filed: Nov. 15, 1984

[30] Foreign Application Priority Data

Nov. 24, 1983 [DE] Fed. Rep. of Germany ..... 3342474

[51] Int. Cl.[4] ..... H01C 10/38

[52] U.S. Cl. ..... 338/179; 338/198; 338/172; 200/157

[58] Field of Search ..... 338/198, 179, 200, 172; 200/15 A, 159 R, 157, 327; 318/268, 249

[56] References Cited

U.S. PATENT DOCUMENTS 3,842,328 10/1974 Supel et al. ..... 338/198 X
3,927,276 12/1975 Lipp ..... 338/198 X
4,137,490 6/1979 Brozoski et al. ..... 338/198 X
4,523,176 6/1985 Leibinger et al. ..... 338/198 X

FOREIGN PATENT DOCUMENTS 0011440 1/1983 European Pat. Off. .
2838934 3/1980 Fed. Rep. of Germany .

*Primary Examiner*—George H. Miller, Jr.
*Assistant Examiner*—M. M. Lateef
*Attorney, Agent, or Firm*—Woodcock Washburn Kurtz Mackiewicz & Norris

[57] ABSTRACT

In a switch, for example, for a device such as a drill, a key switches an electrical switching bridge at the beginning of the key displacement. A variable resistor is adjusted depending on the travel of the key, thereby controlling device speed. In order to achieve an adjustment of the key end stop, a slide displaceable in the transverse direction is mounted on the key, which slide has a stop edge projecting in the longitudinal direction. A stop border is provided on the switch cover and configured relative to the travel of the slide so that the distance between the stop edge and the stop border varies according to the displaced position of the slide, thereby enabling operator control of the device speed.

15 Claims, 4 Drawing Figures

SWITCH WITH SPEED CONTROL

BACKGROUND OF THE INVENTION

The present invention pertains to a switch with a key displaceable in the longitudinal direction into a switch cover against the force of a spring, which said key switches an electric switching bridge at the beginning of its displacement, and which adjusts a variable resistor depending on the length of the displacement path. Such switches are used in electric hand tools, especially hand drills.

A switch of this general type is described in German application DE-OS No. 28 38 934. The motor of the machine is turned on via the switching bridge. The motor speed can be adjusted via a variable resistor or potentiometer. Locking of the key is not provided in the switch according to DE-OS No. 28 38 934.

A switching bridge according to German application DE-OS No. 28 38 934 is of a complicated structure, because it requires a separate draw spring in addition to the spring returning the key. In addition, its opposite contact must be connected to the corresponding terminal via an electrical connection.

In German application DE-OS No. 28 38 934 a slide contact of the variable resistor is displaced with the key in the longitudinal direction on a resistor track. The adjustment path of the resistor is thus equal to the actual travel of the key. This dependence is unfavorable, because the key travel is set based on criteria other than the adjustment path of the slide contact. The switch according to German application DE-OS No. 28 38 934 does not permit the user to preset the resistance value and thus also the speed in the case of a drill, which should be reached upon maximum actuation of the key. The user desires such presetting, e.g., when he is working on a material on which a certain working speed of the machine should not be exceeded. A switch in which a control knob is arranged on the key, such that the knob controls the extent to which the key can be pressed is described in European patent specification No. 00 11 440.

Such a control knob on the face of the key can practically only be operated by switching the machine off and removing it from its working position. The control knob becomes a nuisance for the user when he has to keep the key depressed over a rather long time, as is necessary in most work procedures.

SUMMARY OF THE INVENTION

The primary object of the present invention is to design a switch having a displaceable key which switches an electrical switching bridge, said switch being provided with means such that the end stop of the key can be set without a control knob and without adversely affecting the function of the switching bridge.

The above object is solved according to the present invention by a slide member mounted on the key so as to be displaceable in the direction transverse to the motion of the key. The slide has a stop edge projecting in the longitudinal direction, and a stop border is provided on the switch cover. The stop border is turned toward the stop edge, with the longitudinal distance between the stop edge and the stop border varying according to the transverse position selected for the slide.

By displacing the slide in the transverse direction the available travel of the key can be set by the operator.

The slide is easy to operate, on one hand. On the other hand, it does not interfere with the switch operation when pressing the key. The slide is arranged preferably on a lateral surface of the key, with the face of the key remaining smooth.

In the preferred embodiment of the present invention the key has a toothed rack extending in the longitudinal direction, which meshes a pinion. A slide contact cooperating with a circular arc-shaped resistor track is arranged on the pinion, rotating together with it. This arrangement makes it possible to create a transmission such that a relatively great displacement of the slide contact on the resistor track corresponds to a short travel of the key. This is favorable, because it improves the load-bearing capacity and the accuracy of reproduction of the setting of the resistance tapped by the slide contact on the resistor track. Consequently, if the slide limits the travel of the key to a certain value, the same resistance value is set again and again when the key is pressed to the stop. This guarantees that the device, e.g. the drill, always reaches the same speed at a given slide setting when the key is moved fully to the stop.

As an alternative of the present invention, a push button is provided connected to the shaft of the pinion, which push button has teeth on its circumference, which teeth oppose teeth on the switch cover. During meshing the teeth block each other under the effect of the spring which returns the key. If the push button is pressed at any given position of the key, the teeth mesh with each other, such that the pinion thus becomes non-rotatable. If the key is released the toothed rack continues to press the pinion under the action of the spring, whereby the teeth are blocked. It is beneficial that the key can thus be fixed in any position, regardless of the setting of the slide.

The spring which returns the key assumes not only the return function, but also serves to lock the key. In addition, the spring also actuates the switching bridge. To achieve this, the spring rests against the key on a first end of the switching bridge. The key is provided with a cam which holds the switching bridge in one of its positions against the force of this spring. At the beginning of the displacement of the key the cam movement releases the switching bridge, and the latter tilts into its other switching position under the force of the spring. An additional separate spring for turning the switching bridge thus becomes unnecessary.

BRIEF DESCRIPTION OF THE DRAWINGS

Further advantageous embodiments of the present invention become apparent from the following description as illustrated by the following drawings.

DESCRIPTION OF THE PREFERRED EMBODIMENT

Figure 1:
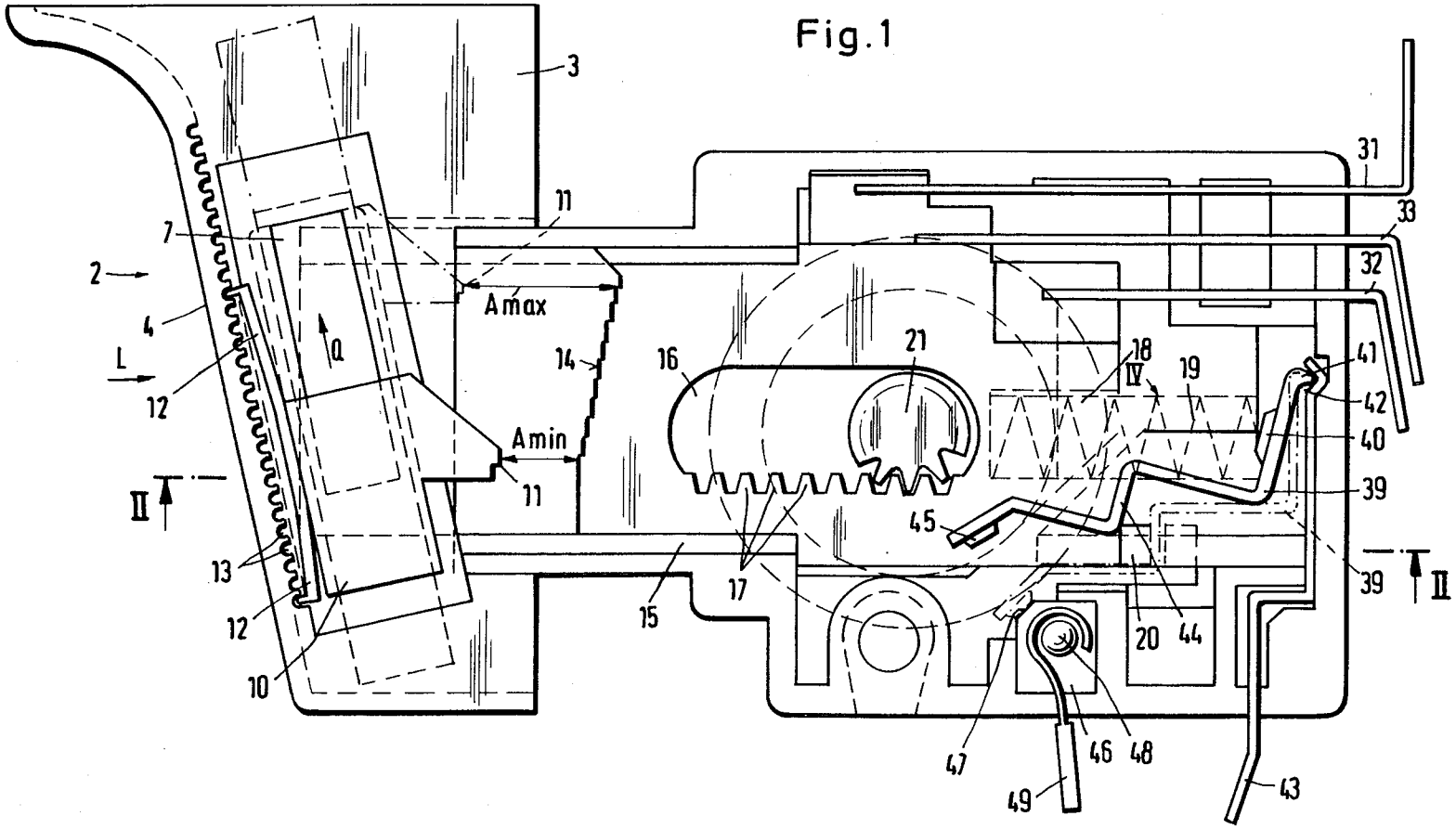
FIG. 1 shows a partial section of a switch in accordance with this invention.
Figure 2:
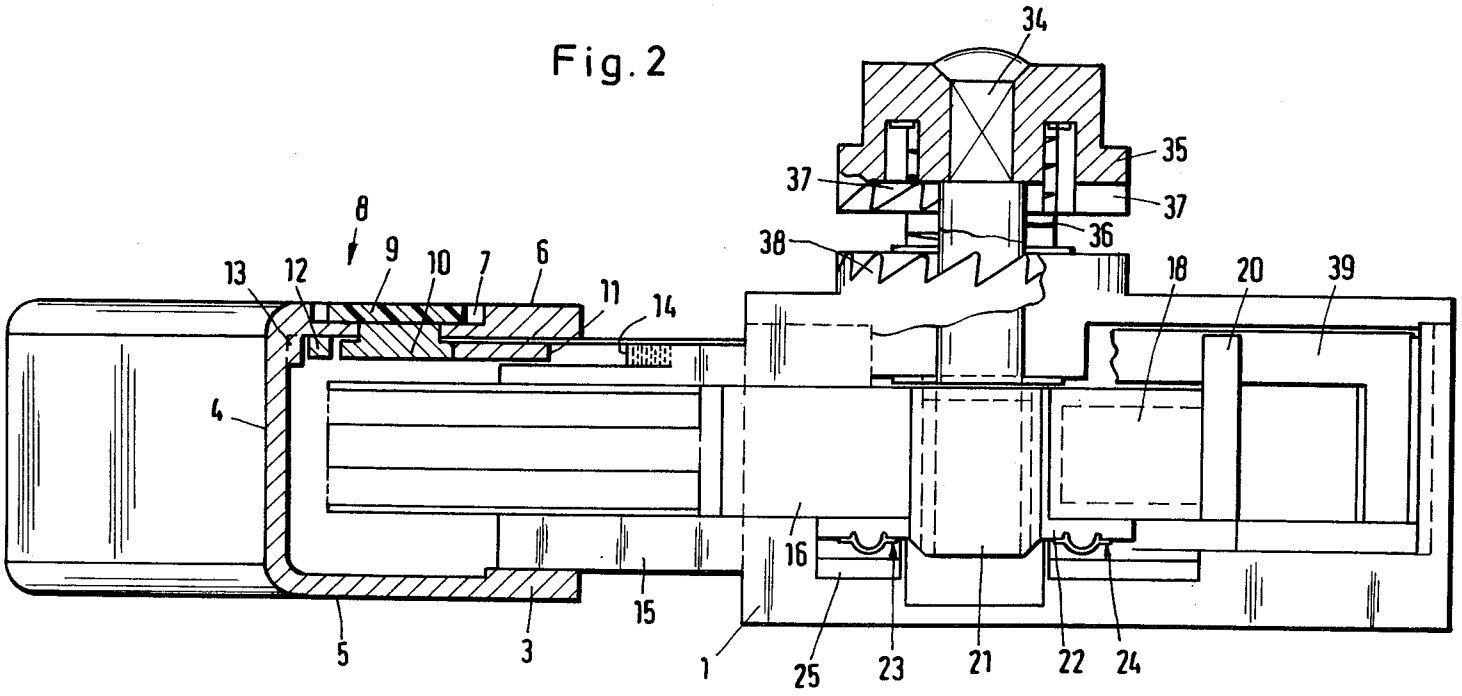
FIG. 2 shows a section of the switch along the line II—II of FIG. 1.

Referring first to FIGS. 1 and 2, a key 2 is arranged to be moveable in the longitudinal direction L in a switch cover 1. The head 3 of the key has a smooth, uninterrupted front surface 4 and similar side surfaces 5 and 6. A recess 7 provided as shown in side 6, which recess extends in the direction Q at right angles to the longitudinal direction L, parallel to the front surface 4.

A slide 8 is slidably guided in recess 7, said slide having an operating panel 9 which is flush with the side surface 6 and a surface which is fluted. A slide body 10 is connected with operating panel 9, which body is located inside the key head 3 and has a stop edge 11 projecting in the longitudinal direction L. Flexible slides 12 are provided on the slide body 10, which slides snap into grooves 13 which are provided on the inside of the front surface 4.

A stepped stop border 14 is provided on the switch cover 1, which opposes the stop edge 11. When slide 8 is in its lowermost position, as shown in solid lines in FIG. 1, the distance between the stop edge 11 and the stop border 14 has its minimum, $A_{min}$. The distance between the stop edge 11 and the stop border 14 assumes its maximum, $A_{max}$, in the uppermost position of the slide 8, as indicated in broken lines.

The key 2 has a body 15 which is guided in the switch cover 1. The key body 15 has an opening 16 which is provided on one of its sides with teeth 17 extending in the longitudinal direction L. A cavity 18 in which a pressure spring 19 is located is provided on the end of the key body 15 away from the key head 3. In addition, a cam 20 is provided on the key body 15.

Figure 3:
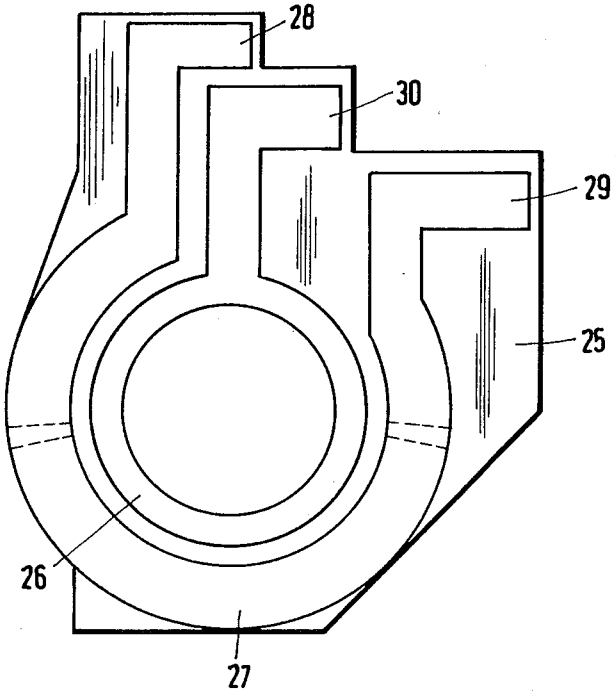
FIG. 3 shows a top view of a circuit board of the switch of this invention.

A pinion 21 meshes with the teeth 17. As seen in FIG. 2, a slide contact holder 22 which carries slide pins 23, 24 is mounted on the pinion 21, rotating together with said pinion. Associated with said pins is a printed circuit board 25 (FIG. 3). An inner conductor ring 26 is printed on printed circuit board 25, and ends in conductor coating 30. Slide pin 23 rests on this inner conducting ring. A resistor strip 27 which ends in the conductor coatings 28 and 29 lies around the inner conductor ring 26 in a circular arc shape. The slide pins 24 lie on the resistor strip 27 and on the conductor coatings 28 and 29. The conductor coatings 28, 29, and 30 are connected to terminal lugs 31, 32 and 33, illustrated in FIG. 1.

Referring to FIG. 2, a push button 35 is located on the shaft of the pinion 21 outside the switch cover 1, mounted on a square 34. This push button rests on the switch cover 1 via a pressure spring 36. Sawteeth 37, which are slightly undercut are provided on the outer circumference of the inside surface of push button 35. Matching sawteeth 38 are provided on the switch cover 1.

Figure 4:
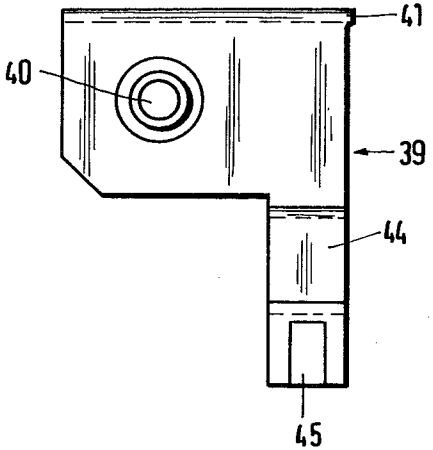
FIG. 4 shows a view of a switching bridge of the switch in the direction indicated by the arrow IV in FIG. 1.

At its end opposite to the cavity 18 the pressure spring 19 rests on a switching bridge 39, which is also illustrated in FIG. 4. To guide the spring 19 the switching bridge 39 is provided with a truncated cone-shaped projection 40. At one end of the switching bridge 39 a bend 41 is provided which lies in a recess 42 of a terminal lug 43. The switching bridge 39 has a step 44, the border of which lies loosely on cam 20 in one of the switching positions. At the other end of the switching bridge 39 a contact surface 45 is provided. A terminal 46 having an opposing contact surface 47 is located in the path of motion of the contact surface 45. The terminal 46 has a threaded bore 48 into which a screw (not shown in detail) is to be screwed to fasten a connecting wire 49.

The terminal lug 43 and the connecting wire 49 are connected to the electric motor of the drill and to the mains. The open switching position of the switching bridge 39 is shown in solid lines in FIG. 1. The closed switching position is shown in broken lines. The switch for the electric motor consists of only three parts, i.e., the terminal lug 43, the switching bridge 39 and the terminal 46. A speed control device of the drill is connected to the terminal lugs 31, 32 and 33.

The switch as above described operates substantially as follows:

Starting from the off position shown in the FIGS. 1 and 2, the front surface 4 is pressed, upon which the key 2 is displaced against the force of the pressure spring 19 in the longitudinal direction L. This causes the cam 20 to release the switching bridge 39, so that the latter rotates under the force of the pressure spring 19 in such a way that its contact surface 45 comes into contact with the opposing contact surface 47. This makes a closed contact to provide current flow via the terminal lug 43, the switching bridge 39, the terminal 46 and the connecting wire 49, so that the drill is running. At the same time that key head 3 is being pressed, the teeth 17 are also displaced, so that the pinion 21 is rotated together with the slide contact holder 22 and the slide pins 23 and 24. At the beginning of this rotation the slide pins 24 are on the resistor track 27, so that the drill runs at minimum speed. In the course of the continued pressing of the key head 3, the teeth 17 rotate the pinion 21 and thus the slide contact holder 22 and the slide pins 23 and 24 further, so that the speed of the drill increases.

If the slide 8 in the key is set in such a way that the distance of its stop edge 11 from the stepped stop border 14 has the lowest possible value ($A_{min}$), the key head 3 can be displaced only by a portion of its maximum travel ($A_{max}$). If the key head 3 is pressed against this stop, the teeth 17 rotate the pinion 21 and thus also the slide pins 24 by such a distance that only a fraction of the maximum speed can be reached. Consequently, the user is able to preset a minimum speed and yet press the key head 3 all the way to the stop. If the user determines in the course of the operation that the preselected speed is too low, he displaces the operating panel 9 of the slide 8 (e.g., with the thumb of the right hand, while the index finger is pressed on the front surface 4) in the direction of the arrow Q without interrupting the drilling operation. This causes the distance between the stop edge 11 and the stepped stop border 14 to increase, so that the pinion 21, and hence the slide pins 24 are turned even further until the next stop position, whereby the speed of the drill increases.

The number of grooves 13 provided for one of the flexible slides 12 is equal to the number of steps of the stepped stop border 14. Thus, when the slide 8 is moved a stepwise adjustment takes place in the grooves 13 due to the snap-in effect of the flexible slides 12. This makes it easier for the user to set the speed to a desired value. In addition, undesired adjustment of the speed selected for an operation, as when the slide 8 moves too easily, is prevented.

The stepping of the stop border 14 is designed in such a way that the user is only able to increase the speed while the drill is running by moving the slide 8. The key head 3 must be released to preselect a lower speed.

Ten adjustment steps are provided in the example. This permits a very fine adjustment of the speed to the actual requirements. If the slide 8 is brought into the end position shown in broken lines in FIG. 1, the speed of the drill can be varied between the minimum and maximum speeds by pressing the key more or less strongly without the variation being hindered by a stop.

The difference in travel between the stop positions $A_{min}$ and $A_{max}$ need not be great. Yet, a broad range of speed adjustment is guaranteed, because the travel of the slide pins 24 during the adjustment of the slide 8 from the $A_{min}$ position to the $A_{max}$ position is considerably greater than the difference in travel between the $A_{min}$ and $A_{max}$ positions.

If the user wishes to lock the key head 3 during prolonged operations, and thus to fix the speed, he presses the push button 35 against the force of the pressure spring 36, which is weak in comparison to the pressure spring 19, when the desired speed is reached until the teeth 37 and 38 mesh with each other. He then releases the key head 3. This causes the pressure spring 19 to press the pinion 21 via the teeth 17, whereby the said pinion rotates by a very small amount, so that the pressure spring 36 is no longer able to disengage the undercut teeth 37 and 38. The position of the pinion 21 and of the pins 24 and hence the speed are thus fixed. The teeth 37 and 38 have at least as many teeth as there are steps on the stop border 14. It is thus possible to fix the speed in just as fine steps as when the key head 3 is pressed continuously to the stop.

If the user wishes to release the fixed position, he presses the front surface 4. This causes the teeth 37 of the push button 35 to be rotated via the teeth 17 and the pinion 21, so that the teeth 37 are disengaged from the teeth 38 under the force of the pressure spring 36.

The pinion 21 is also displaced when pressing the push button 35 in the embodiment being described. However, the teeth of the pinion 21 remain engaged with the teeth 17 during this displacement. The sliding contact holder 22 is not displaced in the process, because it meshes with the teeth of the pinion 21. This coupling of the displacements of the push button 35 and of the pinion 21 is not disturbing, but can be avoided by suitable means.

If the user releases the key head 3 when the teeth 37 and 38 do not mesh with each other, the key 2 is pushed into its starting position under the force of the pressure spring 19. The pinion 21 and the slide pins 24 are turned back via the teeth 17, and the speed is reduced. Finally, the cam 20 hits the step 44 of the switching bridge 39, so that it separates the contact surface 45 from the terminal 46. The drill is thus turned off.

The push button 35 rotates together with the pinion 21. In the arrangement shown in FIG. 1, in which the teeth 17 are in the low position, the push button 35 turns, upon pressing the key head 3, in a counterclockwise direction. If the teeth 17 are at the top, the push button 35 turns clockwise while the key head 3 is being pressed. A marking (not shown specifically) is preferably provided on the circumference of the push button 35, and a matching dial, e.g., from "0" to "6", is provided on the circumference of an opening in the drill casing through which the push button 35 reaches. The forced turning of the push button 35 is thus utilized for displaying the actual speed. The user can estimate the speed actually reached from the position of the marking of the push button 35. Another similar dial can be provided at the stepped stop border 14. This makes it easier for the user to preselect a desired speed by setting the slide body 10. Such a dial can also be provided on the key head 3 beside the slide 8.

The switch described is practically dustproof. In order to improve dustproofness in the region of the push button 35, the spring 36 is preferably provided with a plastic sheath prepared by spraying a soft plastic.

The stop border 14 does not absolutely need to be stepped. It can also be continuous. The variable distance between the stop edge 11 and the stop border 14 can also be achieved by providing a stop surface sloping in steps or continuously on the slide 8 and providing a fixed stop point on the switch cover 1.

The described arrangement of the switching bridge 39 can also be used in switches other than that described.

We claim:

1. A switch having a switch cover and a key displaceable longitudinally with said cover, a spring positioned to provide opposing force to displacement of said key, an electrical switching bridge positioned to be displaced to a switched position at the beginning of said key displacement, and a variable resistor operatively connected to be varied as a function of the longitudinal displacement of said key, characterized by a slide mounted so as to be displaceable in a crosswise direction on said key, said slide acting as a variable limiting function for the permitted range of longitudinal displacement of said key.

2. A switch in accordance with claim 1, characterized in that said slide has a stop edge projecting in the longitudinal direction, a stop border provided on said switch cover and turned toward said stop edge, said stop edge and stop border being configured so that the distance between them in the longitudinal direction is greater in one displaced position of said slide than in another displaced position.

3. A switch in accordance with claim 2, characterized in that said key has teeth extending in said longitudinal direction, a rotatable pinion which meshes with said teeth, and slide pin means attached to said pinion, which said slide pin means rotating together with said pinion, and said switch comprising an arc-shaped resistor track on which said slide pin means slides.

4. A switch in accordance with claim 2 or 3, characterized in that said slide is provided on a lateral surface of said key.

5. A switch in accordance with claim 2, characterized in that said stop border has several steps in it.

6. A switch in accordance with claim 2, characterized in that said slide has at least one snap-in slide, and said key has grooves, said snap-in slide being positionable in any one of said grooves.

7. A switch in accordance with claim 1, characterized in that the number of steps of said stop border is equal to the number of said grooves.

8. A switch in accordance with claim 3, characterized in that the slide pin means has a slide contact holder which meshes with the teeth of said pinion.

9. A switch in accordance with claim 3, characterized in that a push button is connected to said pinion, which said push button has teeth on its circumference, said switch cover having opposing teeth, whereby the teeth are caught in each other during meshing under the force of said spring locking said variable resistor into a given resistance value related to the longitudinal displacement of the key when said push button is depressed.

10. A switch in accordance with claim 9, characterized by connecting means for connecting said pinion and said push button to rotate together.

11. A switch in accordance with claim 2, characterized in that said spring rests against said key on a first end of said switching bridge, said key carrying a cam which holds said switching bridge in one of its positions against the force of said spring, said cam being configured to release said switching bridge at the beginning of displacement of said key, whereby said switching bridge tilts into its other switching position under the force of said spring.

12. A switch in accordance with claim 11, characterized by a terminal, said switching bridge resting directly on said terminal for an electrical connection wire in its other position.

13. A switch in accordance with claim 11 or 12, characterized in that said switching bridge has a first end, and comprising a terminal lug connected to said cover, such that said spring presses said first end of said switching bridge against said terminal lug.

14. A switch for use with a motor driven device, for providing both on-off and speed control, comprising:

a switch cover and a key displaceable longitudinally within said cover, and a spring positioned within said cover to provide a force which opposes displacement of said key, an electrical switching bridge positioned to be displaced to a switched position at the beginning of said key displacement, contact means for providing a continuous conductive path when said switching bridge is in its switched position, a slide mounted on said key and displaceable along a surface of said key in a direction substantially transverse relative to said longitudinal direction, limit means for limiting the longitudinal displacement of said key as a function of the position of said slide, electrical outlet elements for transmitting speed control signals, an adjustable electrical element in series with said electrical outlet elements, transmission means for adjusting the value of said electrical element as a function of the longitudinal displacement of said key, and said key carrying bridge displacing means for displacing said electrical bridge only at the beginning of displacement of said key, whereby said contact means provides a continuous conductive path for turning on said motor and said conductive path is not interrupted by further displacement of said key for purposes of speed control.

15. The switch as described in claim 14, further comprising a pushbutton means cooperating with said transmission means for maintaining the position of said adjustable electrical element even when said key is retracted.

* * * * *